US009404624B2

(12) United States Patent
Chung

(10) Patent No.: US 9,404,624 B2
(45) Date of Patent: Aug. 2, 2016

(54) LIGHTING APPARATUS

(71) Applicant: LG INNOTEK CO., LTD., Seoul (KR)

(72) Inventor: Won Suk Chung, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/416,802

(22) PCT Filed: Jul. 18, 2013

(86) PCT No.: PCT/KR2013/006453

§ 371 (c)(1),
(2) Date: Jan. 23, 2015

(87) PCT Pub. No.: WO2014/017781

PCT Pub. Date: Jan. 30, 2014

(65) Prior Publication Data

US 2015/0211687 A1 Jul. 30, 2015

(30) Foreign Application Priority Data

Jul. 23, 2012 (KR) ..... 10-2012-0079877
Aug. 16, 2012 (KR) ..... 10-2012-0089324

(51) Int. Cl.

| | |
|---|---|
| ***H05B 37/02*** | (2006.01) |
| ***F21K 99/00*** | (2016.01) |
| ***F21V 23/04*** | (2006.01) |
| ***F21V 29/76*** | (2015.01) |

(Continued)

(52) U.S. Cl.

CPC ..... *F21K 9/135* (2013.01); *F21V 23/045* (2013.01); *F21V 29/74* (2015.01); *F21V 29/763* (2015.01); *H05B 37/0272* (2013.01); *F21Y 2101/02* (2013.01); *F21Y 2105/001* (2013.01)

(58) Field of Classification Search

CPC ..... F21K 9/135; F21V 23/045; F21V 29/74; F21V 29/763; F21Y 2101/001; F21Y 2101/02; H05B 37/0272

See application file for complete search history.

(56) References Cited

U.S. PATENT DOCUMENTS 6,295,031 B1 9/2001 Wallace et al.
7,521,872 B2 * 4/2009 Bruning ..... H05B 33/0821 315/149

(Continued)

FOREIGN PATENT DOCUMENTS

CN 1849707 A 10/2006
CN 201661913 U 12/2010

(Continued)

OTHER PUBLICATIONS

European Search Report dated Sep. 23, 2013 issued in Application No. 13177493.0.

(Continued)

*Primary Examiner* — Jason M Crawford
*Assistant Examiner* — Kurtis R Bahr
(74) *Attorney, Agent, or Firm* — KED & Associates, LLP

(57) ABSTRACT

Disclosed is a lighting apparatus. The lighting apparatus includes a lighting apparatus including a control module supplying an electric power; a heat sink receiving the control module; a light source module mounted on the heat sink and including a light source connected to the control module; and an antenna device disposed on the light source module and connected to the control module. Since the lighting apparatus is wirelessly controllable, a user of the lighting apparatus can easily control the lighting apparatus.

12 Claims, 8 Drawing Sheets

(51) Int. Cl.

| | |
|---|---|
| ***F21V 29/74*** | (2015.01) |
| *F21Y 101/02* | (2006.01) |
| *F21Y 105/00* | (2016.01) |

(56) References Cited

U.S. PATENT DOCUMENTS

| | | | | |
|---|---|---|---|---|
| 8,633,646 | B2 * | 1/2014 | Molezion | H01Q 1/007 315/307 |
| 9,184,497 | B2 * | 11/2015 | Chen | H01Q 1/38 |
| 2007/0007898 | A1 | 1/2007 | Bruning | 315/34 |
| 2007/0014549 | A1 | 1/2007 | Demarest et al. | |
| 2007/0229250 | A1 | 10/2007 | Recker et al. | |
| 2007/0252528 | A1 * | 11/2007 | Vermuelen | F21V 3/04 315/34 |
| 2008/0272714 | A1 | 11/2008 | Noble et al. | |
| 2010/0327766 | A1 * | 12/2010 | Recker | H02J 9/02 315/291 |
| 2011/0063849 | A1 | 3/2011 | Alexander et al. | |
| 2012/0069545 | A1 * | 3/2012 | Choi | F21K 9/135 362/84 |
| 2012/0274208 | A1 | 11/2012 | Chen et al. | 315/34 |
| 2013/0026927 | A1 | 1/2013 | Uhara | |
| 2013/0249392 | A1 * | 9/2013 | Kim | F21V 29/004 315/34 |
| 2013/0285544 | A1 | 10/2013 | Molezion | |
| 2015/0103515 | A1 * | 4/2015 | Bosua | H05B 37/0272 362/157 |
| 2015/0327349 | A1 * | 11/2015 | Lee | H05B 37/0272 362/294 |
| 2015/0338074 | A1 * | 11/2015 | Chen | F21V 29/50 362/294 |

FOREIGN PATENT DOCUMENTS

| | | | |
|---|---|---|---|
| CN | 102086982 | A | 6/2011 |
| CN | 202056583 | U | 11/2011 |
| CN | 102466160 | A | 5/2012 |
| JP | H10-190511 | A1 | 7/1998 |
| JP | 2007-505448 | A | 3/2007 |
| JP | 2008-028734 | A | 2/2008 |
| JP | 2011-228130 | A | 11/2011 |
| JP | 2012-079498 | A | 4/2012 |
| JP | 4944282 | B1 | 5/2012 |
| JP | 2012-227021 | A | 11/2012 |
| JP | 2013-140751 | A | 7/2013 |
| KR | 10-2004-0080398 | A | 9/2004 |
| KR | 10-2012-0036937 | A | 4/2012 |
| WO | WO 2006/014069 | A1 | 2/2006 |
| WO | WO 2010/140136 | A1 | 12/2010 |
| WO | WO 2011/129309 | A1 | 10/2011 |

OTHER PUBLICATIONS

Japanese Office Action dated May 27, 2014 issued in Application No. 2013-152572.

U.S. Office Action dated Nov. 19, 2014 issued in U.S. Appl. No. 13/948,875.

European Search Report dated Jun. 18, 2015 issued in Application No. 13823396.0.

International Search Report dated Oct. 28, 2013 issued in Application No. PCT/KR2013/006453.

European Search Report dated Feb. 15, 2016 issued in Application No. 15195117.5.

Chinese Office Action dated Mar. 3, 2016 issued in Application No. 201380039052.3 (Original Office Action and English Translation).

* cited by examiner

LIGHTING APPARATUS

CROSS-REFERENCE TO RELATED PATENT APPLICATIONS

This application is a U.S. National Stage Application under 35 U.S.C. §371 of PCT Application No. PCT/KR2013/006453, filed Jul. 18, 2013, which claims priority to Korean Patent Application Nos. 10-2012-0079877, filed Jul. 23, 2012 and 10-2012-0089324, filed on Aug. 16, 2012, whose entire disclosures are hereby incorporated by reference.

TECHNICAL FIELD

The embodiment relates to a lighting apparatus.

BACKGROUND ART

In general, various types of lighting apparatuses such as ceiling-mounting type lamps, scenery lighting lamps, sleeping lamps, and stand lamps exist according to purposes thereof. The lighting apparatuses must irradiate light with sufficient luminance level according to purposes. Accordingly, recently, a light emitting diode (LED) has been used for a lighting apparatus. In comparison with other light sources such as a fluorescent lamp and an incandescent lamp, the LED is advantageous because of low power consumption, a long lifetime, a fast response time, safety, and environment-friendliness. Accordingly, many studies and researches to replace the existing light sources with the light emitting diode have been carried out.

However, the above lighting apparatuses are turned-on/off by a switch connected to the lighting apparatuses through a cable. Accordingly, a user of the lighting apparatus must inconveniently control the lighting apparatus.

DISCLOSURE

Technical Problem

Therefore, the embodiment provides a lighting apparatus which is easily controllable.

Technical Solution

According to the embodiment, there is provided a lighting apparatus including a control module supplying an electric power; a heat sink receiving the control module; a light source module mounted on the heat sink and including a light source connected to the control module; and an antenna device disposed on the light source module and connected to the control module.

Advantageous Effects

According to the embodiment, the lighting apparatus has the wireless communication function. The lighting apparatus can receive the wireless control signal. The lighting apparatus is capable of controlling the light source according to the wireless control signal, so that the lighting apparatus is wirelessly controllable. That is, a user can easily control the lighting apparatus. Thus, the convenience of the user using the lighting apparatus can be improved.

BEST MODE

Mode for Invention

Figure 1:
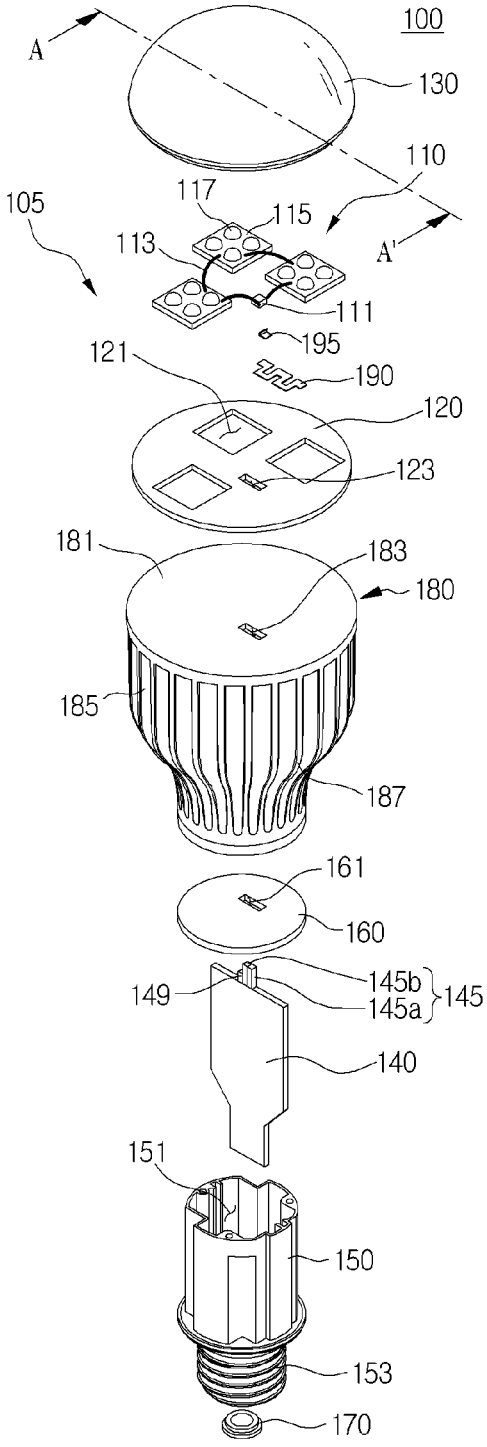
FIG. 1 is an exploded perspective view showing a lighting apparatus according to the first embodiment.

Hereinafter, the embodiment will be described in more detail with reference to the accompanying drawings. The same reference numerals will be used to refer to the same elements throughout the drawings. In addition, a detailed description of known functions and configurations which make the subject matter of the disclosure unclear will be omitted.

In the description of the embodiments, it will be understood that, when an element is referred to as being "on" or "under" another element, it can be "directly" or "indirectly" on the other element, or one or more intervening elements may also be present. Such a position of an element has been described with reference to the drawings.

Figure 2:
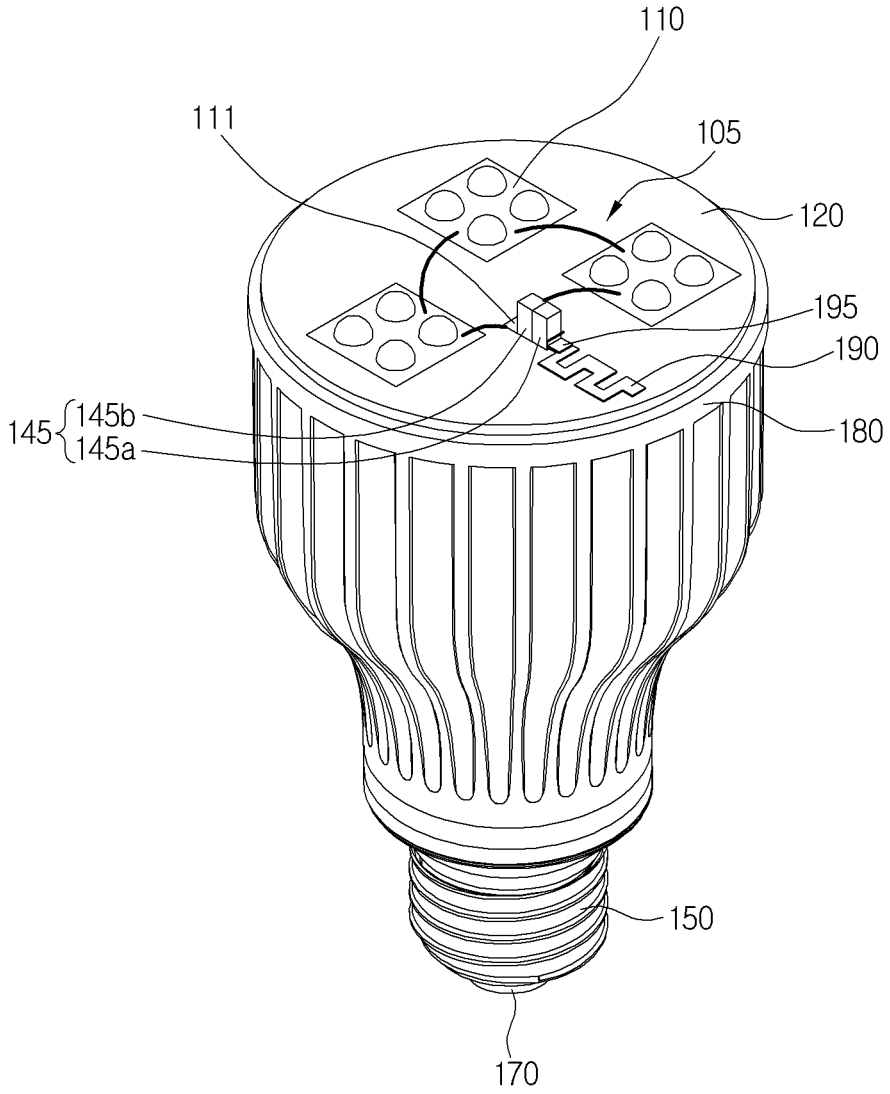
FIG. 2 is a perspective view showing the assembly structure of the lighting apparatus according to the first embodiment.
Figure 3:
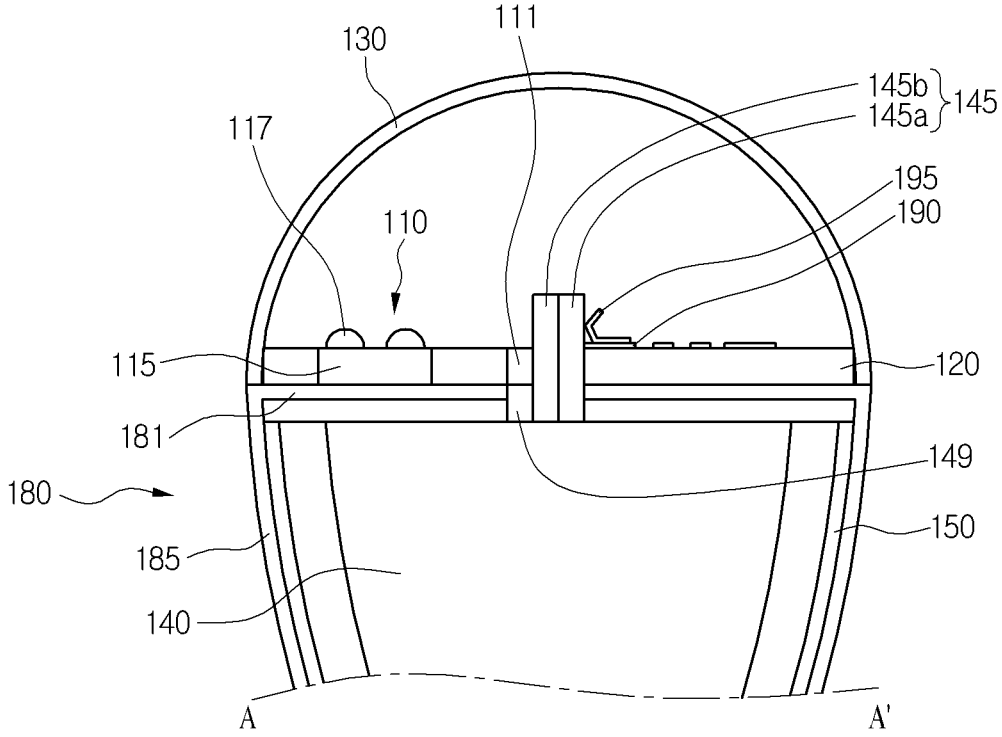
FIG. 3 is a sectional view taken along line A-A' in FIG. 1.
Figure 4:
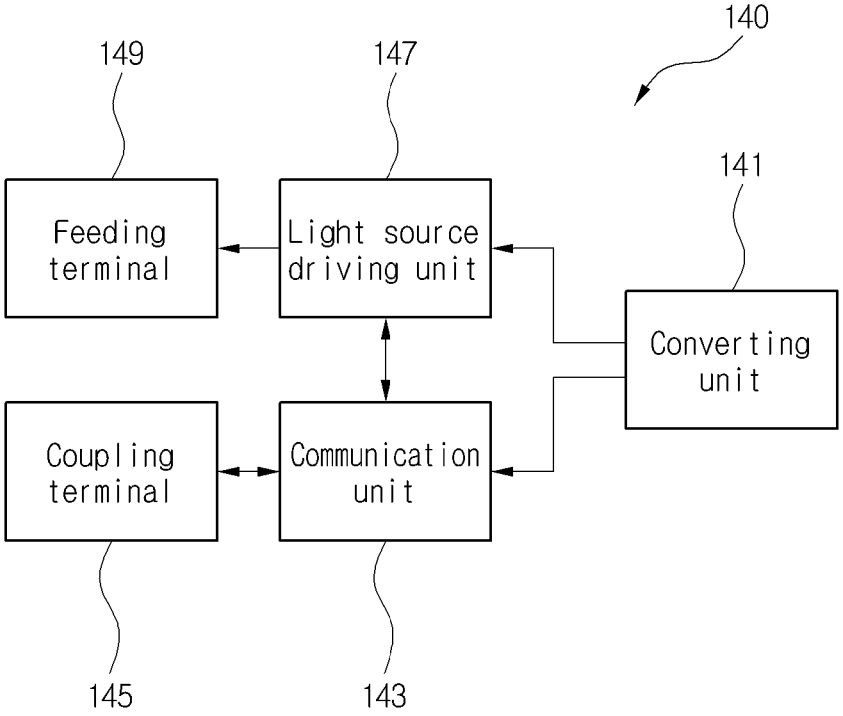
FIG. 4 is a block diagram showing a detailed configuration of a control module in FIG. 1.

FIG. 1 is an exploded perspective view showing a lighting apparatus according to the first embodiment. FIG. 2 is a perspective view showing the assembly structure of the lighting apparatus according to the first embodiment. FIG. 3 is an sectional view taken along line A-A' in FIG. 1. FIG. 4 is a block diagram showing a detailed configuration of a control module in FIG. 1.

Referring to FIGS. 1 to 4, the lighting apparatus 100 according to the embodiment includes a light source module 105, a light distribution cover 130, a control module 140, a housing 150, a shield cover 160, a feeding cover 170, a heat sink 180, an antenna device 190, and a contact member 195. The light source module 105 includes a light source 110 and a light source coupling part 120.

A light source 110 generates light. The light source 110 may include a light emitting diode. The light source 110 includes a feeding device 111, a plurality of feeding wires 113, a plurality of base substrates 115, and a plurality of LED (Light Emitting Diode) devices 117.

The feeding device 111 provides electric power in the light source 110. The feeding device 111 may include a PCB (Printed Circuit Board).

The feeding wires 113 connect the feeding device 111 to the base substrates 115. The feeding wires 113 may directly connect the feeding device 111 to each of the base substrates 115. To the contrary, the feeding wires 113 may connect the feeding device 111 to some of the base substrates 115 and may connect the base substrates 115 to each other. In addition, the feeding wires 113 transfers electric power from the feeding device 111 to the base substrates 115.

The base substrates 115 control the light source 110. The base substrates 115 apply the electric power of the feeding device 111 to the LED devices 117. The base substrates may include PCBs.

The LED devices 117 are mounted on the base substrates 115. The plurality of LED devices 117 may be mounted on each base substrate 115. The LED devices 117 generate lights according to the electric power applied from the base substrates 115. That is, the LED devices 117 emit lights.

The light source coupling part 120 is coupled to the light source 110 to fix the light source 110 thereto. At least one fixing hole 121 and at least coupling hole 123 are formed in the light source coupling part 120. The base substrate 115 is disposed in the fixing hole 121. The base substrate 115 and the LED devices 117 are fixed to the light source coupling part 120 in the fixing hole 121. The light source coupling part 120 exposes the LED device 117 through the fixing hole 121. The feeding device 111 is disposed in the coupling hole 123. The coupling hole 123 has a size larger than that of the feeding device 111. In addition, the feeding device 111 is exposed through the coupling hole 123 of the light source coupling part 120. The light source coupling part 120 may be formed of an insulation material. Further, the light source coupling part 120 may have a thickness of about 2.5 mm or more.

The light distribution cover 130 surrounds the light source 110 over the light source coupling part 120. The light distribution cover 130 may have a bulb shape in which an opening is formed. The light distribution cover 130 protects the light source 110 and discharges the light from the light source 110. The light distribution cover 130 discharges the light forward or backward. The light distribution cover 130 may be formed of at least one of glass, plastic, polypropylene and polyethylene. Further, the light distribution cover 130 may be formed of polycarbonate having superior light resistance, thermal resistance and impact strength. Ivory white paint may be coated on the inner surface of the light distribution cover 130 facing the light source 110. The paint may include a diffusion material for diffusing light.

The control module 140 controls all operations of the lighting apparatus 100. The control module 140 may include a PSU (Power Supply Unit). The control module 140 includes a converting unit 141, a communication unit 143, a coupling terminal 145, a light source driving unit 147 and a feeding terminal 149. The converting unit 141, communication unit 143 and light source driving unit 147 are installed in the control module 140. Meanwhile, the coupling terminal 145 and the feeding terminal 149 are protruded from the control module 140. The coupling terminal 145 and the feeding terminal 149 face the coupling hole 123. The coupling terminal 145 may be protruded toward the antenna device 190 and the feeding terminal 149 may be protruded toward the feeding device 111. The coupling terminal 145 may be protruded higher than the feeding terminal 149.

The converting unit 141 is connected to an external power source (not shown). The converting unit 141 converts AC power of the external power source into DC power.

The communication unit 143 drives the antenna device 190. The communication unit 143 provides electric power to the antenna device 190. The communication unit 143 grounds the antenna device 190. The communication unit 143 receives a wireless control signal through the antenna device 190.

The coupling terminal 145 is connected to the communication unit 143. The coupling terminal 145 makes contact with the antenna device 190. The coupling terminal 145 passes through the coupling hole 123. The coupling terminal 145 is protruded over the light source coupling part 120. The coupling terminal 145 makes contact with the contact member 195. In addition, the coupling terminal 145 makes contact with the antenna device 190 through the contact member 195. The coupling terminal 145 connects the communication unit 143 to the contact member 195. That is, the coupling terminal 145 connects the communication unit 143 to the antenna device 190. The coupling terminal 145 includes a first coupling terminal **145*a* and a second coupling terminal 145*b*. The first coupling terminal 145*a* provides the electric power from the communication unit 143 to the antenna device 190. The second coupling terminal 145*b* grounds the antenna device 190 to the communication unit 143**.

The light source driving unit 147 drives the light source 110. The light source driving unit 147 provides electric power to the light source 110. The light source driving unit 147 controls the light source 110 according to the wireless control signal.

The feeding terminal 149 is connected to the light source driving unit 147. The feeding terminal 149 is connected to the light source 110. The feeding terminal 149 makes contact with the feeding device 111 of the light source 110. The feeding terminal 149 makes contact with a lower portion of the feeding device 111 under the light source coupling part 120. That is, the feeding terminal 149 connects the light source driving unit 147 to the feeding device 111. The feeding terminal 149 provides electric power to the light source 110. The feeding terminal 149 provides electric power to the feeding device 111.

The housing 150 receives the control module 140. A receiving hole 151 is formed in the housing 150. The housing 150 receives the control module 140 through the receiving hole 151. The housing 150 may have a cylindrical shape. The housing 150 may prevent the control module 140 and the heat sink 180 from being short-circuited to each other. The housing 150 may be formed of a material having excellent insulation and durability. The housing 150 may be formed of a resin.

The housing 150 includes a connecting terminal 153. The housing 150 is coupled to an external power source through the connecting terminal 153. The connecting terminal 153 may be coupled to the external power source through a socket scheme. The connecting terminal 153 may make electrical contact with the external power source. That is, the connecting terminal 153 may be electrically connected to the external power source. In this case, the connecting terminal 153 may be formed of a conductive material.

The shield cover 160 seals the housing 150. The receiving hole 151 of the housing 150 is covered with the shield cover 160 at an upper portion of the housing 150. The shield cover 160 may prevent the control module 140 and the heat sink 180 from being short-circuited to each other. The shield cover 160 may be formed of a material having excellent insulation and durability. Further, the shield cover 160 may be formed of a resin.

At least one through-hole 161 is formed in the shield cover 160. The through-hole 161 is disposed on the same axis as the coupling hole 123. The through-hole 161 receives the coupling terminal 145 and the feeding terminal 149. The through-hole 161 passes through the coupling terminal 145 and the feeding terminal 149. The coupling terminal 145 and the feeding terminal 149 are exposed through the through-hole 161 of the shield cover 160. The coupling terminal 145 is protruded through the through-hole 161 toward the antenna device 190. The feeding terminal 149 is protruded through the through-hole 161 toward the feeding device 111.

The feeding cover 170 seals the housing 150. The receiving hole 151 of the housing 150 is covered with the feeding cover 170 at a lower portion of the housing 150. The feeding cover 170 makes contact with the external power source. The feeding cover 170 electrically connects the control module 140 to the external power source. The feeding cover 170 may be made of a conductive material.

The heat sink 180 receives the control module 140, the housing 150 and the shield cover 160. A receiving groove (not shown) is formed in the heat sink 180. That is, the control module 140, the housing 150 and the shield cover 160 are received in the receiving groove of the heat sink 180. The light source 110 is mounted on the heat sink 180. The heat generated from the light source 110 is released through the heat sink 180, so that the control module 140 is protected from the heat generated from the light source 110. The heat sink 180 includes a first heat sink 181 and a second heat sink 185.

The first heat sink 181 is disposed on the shield cover 160. The first heat sink 181 is coupled to the light distribution cover 130. The first heat sink 181 is coupled to the light distribution cover 130 at a periphery thereof. The light source 110 and the light source coupling part 120 are mounted on the first heat sink 181. The first heat sink 181 makes contact with the light source 110. The heat generated from the light source 110 is transferred to the second heat sink 185 through the first heat sink 181. The first heat sink 181 may have a cylindrical shape. The first heat sink 181 may have a plane shape.

At least one inserting hole 183 is formed in the first heat sink 181. The inserting hole 183 is disposed on the same axis as those of the coupling hole 123 and the through-hole 161. The coupling terminal 145 and the feeding terminal 149 are received in the inserting hole 183. The coupling terminal 145 and the feeding terminal 149 pass through the inserting hole 183. The coupling terminal 145 and the feeding terminal 149 are exposed through the inserting hole 183 of the first heat sink 181. That is, the coupling terminal 145 is protruded through the inserting hole 183 toward the contact member 195. The feeding device 111 is protruded through the inserting hole 183.

The second heat sink 185 surrounds the housing 150. The second heat sink 185 exposes the connecting terminal 153. That is, the second heat sink 185 surrounds the housing 150 except for the connecting terminal 153. The second heat sink 185 may have a cylindrical shape. The second heat sink 185 extends downward from the first heat sink 181. A diameter of the second heat sink 185 may be reduced as the second heat sink 185 extends downward along the central axis of the first heat sink 181. The heat generated from the light source 110 is released through the second heat sink 185.

The second heat sink 185 includes a plurality of heat sink fins 187, so that the surface area of the second heat sink 185 is increased due to the heat sink fins 187. As the surface area of the second heat sink 185 is larger, the heat release efficiency of the second heat sink 185 is improved. The heat sink fins 187 extend downward from the first heat sink 181. The heat sink fins 187 may be disposed radially from the central axis of the first heat sink 181. The heat sink fins 187 may be protruded in the direction perpendicular to the central axis of the first heat sink 181.

The antenna device 190 performs a wireless communication function of the lighting apparatus 100. The antenna device 190 resonates in a predetermined frequency band, so that the antenna device 190 transceives an electromagnetic wave. The antenna device 190 resonates at a predetermined impedance.

The antenna device 190 is mounted on the light source coupling part 120. The antenna device 190 is disposed at an outside of the heat sink 180. The antenna device 190 is exposed from the heat sink 180. The antenna device 190 is spaced apart from the heat sink 180. The antenna device 140 is spaced apart from the heat sink 180 by a distance corresponding to a thickness of the light source coupling part 120. For example, a gap distance d between the antenna device 140 and the heat sink 180 may be about 2.5 mm or more. In addition, the antenna device 190 may be spaced apart from the light source 110.

The antenna device 190 is connected to the control module 140. The antenna device 190 is connected to the coupling terminal 145. The antenna device 190 makes contact with the contact member 195. The antenna device 190 is connected to the coupling terminal 145 through the contact member 195. In addition, the antenna device 190 is connected to the communication unit 143 through the coupling terminal 145. Thus, an electric power is provided from the communication unit 143 to the antenna device 190. The antenna device 190 is grounded through the communication unit 143. One end of the antenna device 190 is connected to the communication unit 143 and the opposite end of the antenna device 190 is opened.

The antenna device 190 is driven by using the electric power provided through the coupling terminal 145. The antenna device 190 receives a wireless control signal for controlling the control module 140. The antenna device 190 transmits a wireless control signal to the control module 140. The antenna device 190 transmits the wireless control signal to the control module 140 through the coupling terminal 145.

The antenna device 190 may be formed in a patch type and thus, may be attached to the light source coupling part 120. The antenna device 190 may be formed on the light source coupling part 120 by drawing the antenna device 190 with a conductive ink. Also, the antenna device 190 may be patterned on the light coupling part 120. The antenna device 190 may be formed in at least one of bar, meander, spiral, step and loop types. The antenna device 190 may be made of a conductive material. The antenna device 190 may include at least one of Ag, Pd, Pt, Gu, Au and Ni.

The contact member 195 is connected to the antenna device 190. The contact member 195 is closed to the antenna device 190. In this case, one end of the contact member 195 makes contact with the antenna device 190. The contact member 195 extends from the antenna device 190. The contact member 195 is protruded from the antenna device 190. After the contact member 195 is bent from the antenna device 190, the contact member 195 may be The contact member 195 allows the antenna device 190 to make contact with the control module 140. An opposite end of the contact member 195 makes contact with the coupling terminal 145. The contact member 195 may make contact with a side surface of the coupling terminal 145 over the light source coupling part 120. That is, the contact member 195 allows the antenna device 190 to make contact with the coupling terminal 145. Further, the contact member 195 allows the antenna device 190 to make contact with the communication unit 143 through the coupling terminal 145. In addition, the contact member 145 provides the electric power from the communication unit 143 to the antenna device 190, and allows the antenna device 190 to be grounded through the communication unit 143.

The contact member 195 may be made of the same material as that of the antenna device 190. The contact member 195 may be made of a material different from that of the antenna device 190. The contact member 195 may be made of a conductive material. The contact member 195 may include at least one of Ag, Pd, Pt, Cu, Au and Ni.

According to the embodiment, the lighting apparatus 100 has a wireless communication function. The lighting apparatus 100 may receive a wireless control signal through the antenna device 190. The lighting apparatus 100 may control the light source 110 according to the wireless control signal. Thus, the lighting apparatus 100 is wireless-controllable.

That is, a user of the lighting apparatus 100 can easily control the lighting apparatus 100. Thus, the user convenience of the lighting apparatus 100 may be improved.

Meanwhile, although an example including the control module 140 and the communication unit 143 is disclosed in the above-described embodiment, the embodiment is not limited thereto. That is, even though the control module 140 does not include the communication unit 143, the embodiment can be implemented. As an example thereof, the second embodiment will be described below.

Figure 5:
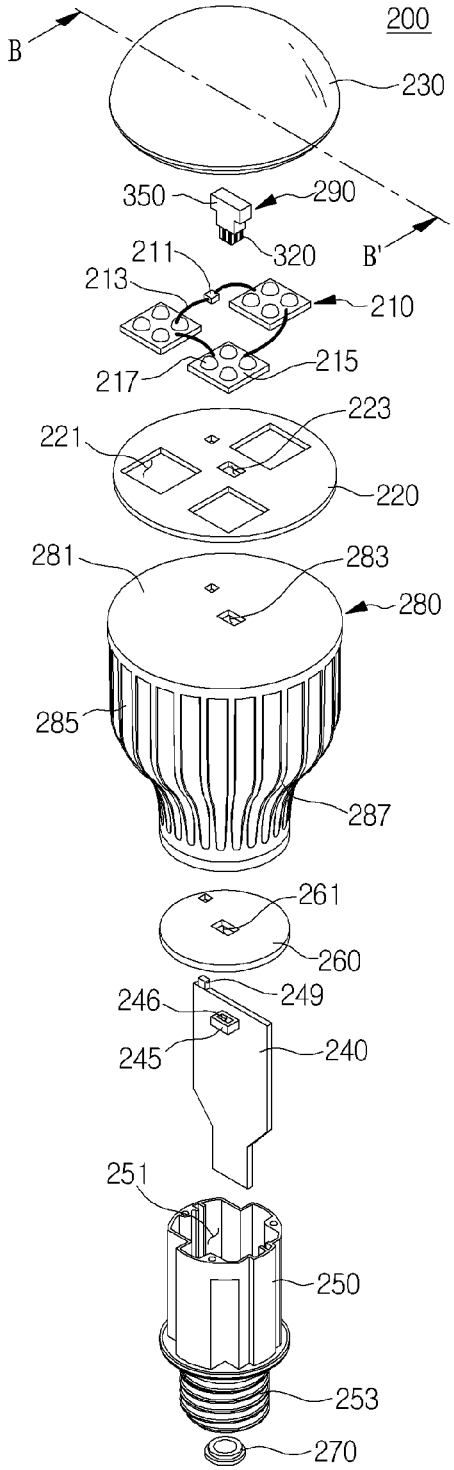
FIG. 5 is an exploded perspective view showing a lighting apparatus according to the second embodiment.
Figure 6:
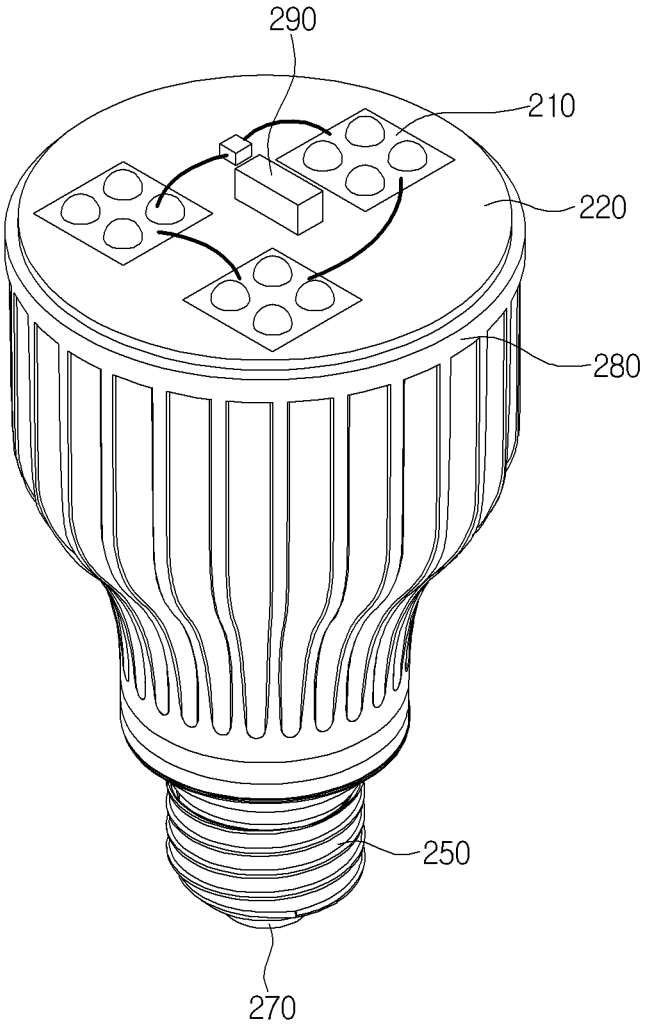
FIG. 6 is a perspective view showing the assembly structure of the lighting apparatus according to the second embodiment.
Figure 7:
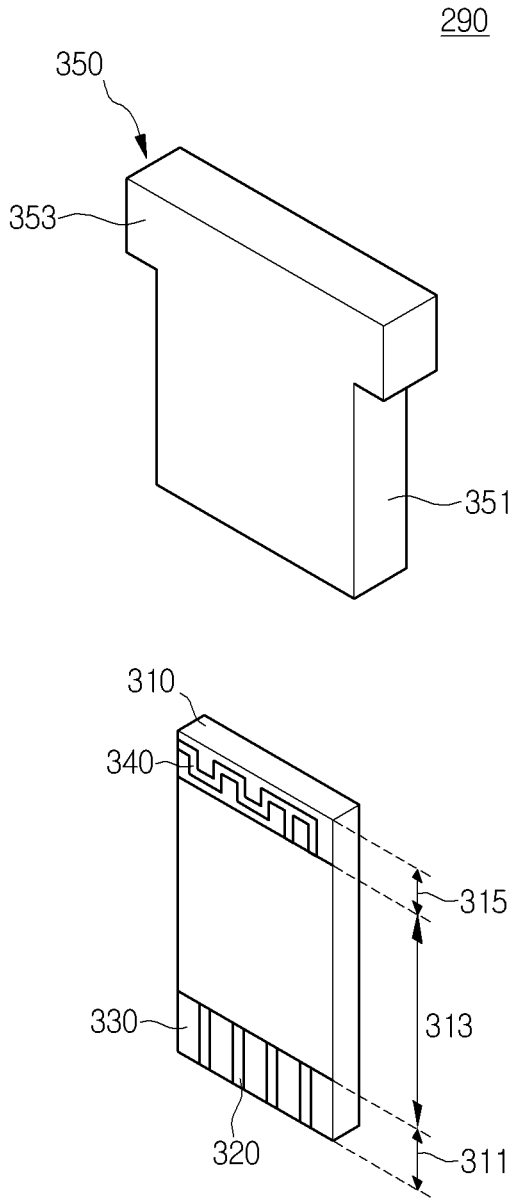
FIG. 7 is an exploded perspective view showing a communication module in FIG. 5.
Figure 8:
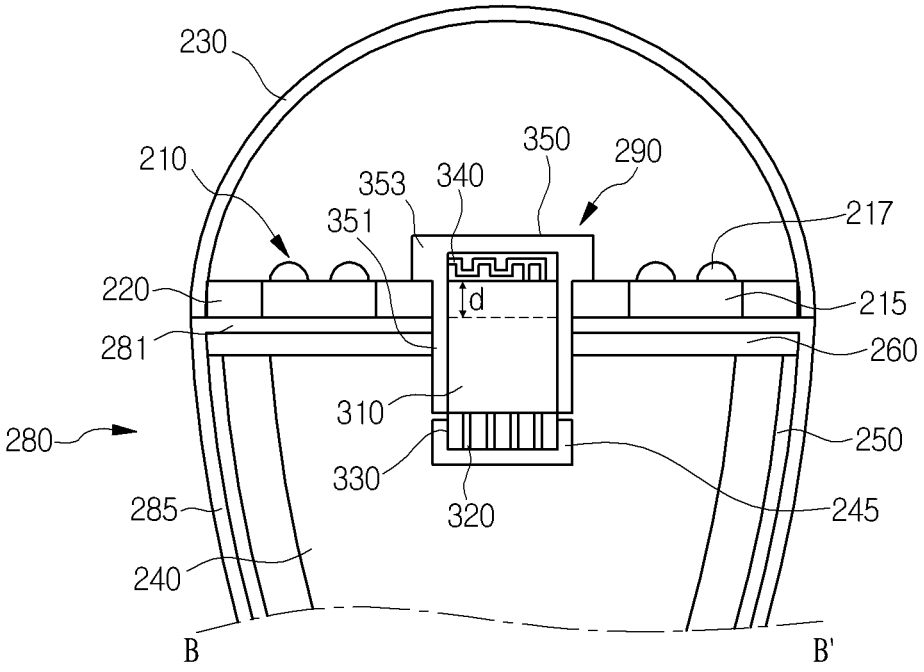
FIG. 8 is a sectional view taken along line B-B' in FIG. 5.

FIG. 5 is an exploded perspective view showing a lighting apparatus according to the second embodiment. FIG. 6 is a perspective view showing the assembly structure of the lighting apparatus according to the second embodiment. FIG. 7 is an exploded perspective view showing a communication module in FIG. 5. FIG. 8 is a sectional view taken along line B-B' in FIG. 5.

Referring to FIGS. 5 to 8, the lighting apparatus 100 according to the second embodiment includes a light source 210, a light source coupling part 220, a light distribution cover 230, a control module 240, a housing 250, a shield cover 260, a feeding cover 270, a heat sink 280, and a communication module 290. an antenna device 190, and a contact member 195. Since the configurations of the light source 210, the light source coupling part 220, the light distribution cover 230, the control module 240, the housing 250, the shield cover 260, the feeding cover 270 and the heat sink 280 are similar to those described above, the detailed description thereof will be omitted.

That is, the light source 210 includes a feeding device 211, a plurality of feeding wires 213, a plurality of base substrates 215, and a plurality of LED (Light Emitting Diode) devices 217. At least one fixing hole 221 and at least coupling hole 223 are formed in the light source coupling part 220. A receiving hole 251 is formed in the housing 250 which includes the connecting terminal 253. In addition, at least one through-hole 261 is formed in the shield cover 260. A receiving groove (not shown) is formed in the heat sink 280 which includes a first heat sink 281 and a second heat sink 285. At least one inserting hole 283 is formed in the first heat sink 281. The second heat sink 285 includes a plurality of heat sink fins 287.

However, according to the second embodiment, the feeding device 211 and the communication module 290 are disposed in the coupling hole 223. The light source coupling part 220 exposes the feeding device 211 and the communication module 290 through the coupling hole 223. The communication module 290 passes through the coupling hole 223. That is, the communication module 290 is protruded in two directions about the light source coupling part 220.

According to the second embodiment, the control module 240 includes a converting unit (not shown), a coupling terminal 245, a light source driving unit (not shown) and a feeding terminal 249. In this case, the configurations of the converting unit, the light source driving unit and the feeding terminal 249 are similar to those of the corresponding elements described above. Meanwhile, the coupling terminal 245 of the control module 240 according to the second embodiment is connected to the converting unit. The coupling terminal 245 is connected to the communication module 245. The coupling terminal 145 is coupled to the communication module 290. The coupling terminal 245 may receive the communication module 290. A coupling groove 246 may be formed in the coupling terminal 245. The coupling groove 246 may face the communication module 290. The communication module 290 is received in the coupling groove 246. The coupling terminal 245 is connected to the communication module 190. The coupling terminal 245 allows the converting module to connect with the communication 290.

Thus, the coupling terminal 245 of the control module 240 according to the embodiment provides electric power to the communication module 290. That is, the control module 240 provides electric power to the communication module 290 through the coupling terminal 245. The coupling terminal 245 receives a wireless control signal for controlling the control module 240 from the communication module 290. That is, the control module 240 receives the wireless control signal from the communication module 290 through the coupling terminal 245.

The through-hole 261 in the shield cover 260 according to the embodiment is disposed on the same axis as the coupling hole 223. The feeding terminal 249 and the communication module 290 are received in the through-hole 261. The feeding terminal 249 and the communication module 290 passes through the through-hole 261. The feeding terminal 249 and the coupling terminal 245 are exposed through the through-hole 261 of the shield cover 260. The feeding terminal 249 and the coupling terminal 245 are protruded through the through-hole 261 toward the feeding device 211. The communication module 290 is protruded toward coupling terminal 245 through the through-hole 261.

In addition, the inserting hole 283 of the first heat sink 281 is disposed the same axis as the coupling hole 223 and the through-hole 261. The feeding terminal 249 and the communication module 290 is received in the inserting hole 283. The feeding terminal 249 and the communication module 290 passes through the inserting hole 283. The feeding terminal 249 and the coupling terminal 245 are exposed through the inserting hole 283 of the first heat sink 281. That is, the feeding terminal 249 is protruded toward the feeding device 211 through the inserting hole 283. Further, the communication module 290 is protruded toward the coupling terminal 245 through the inserting hole 283.

In addition, according to the embodiment, the communication module 290 receives the wireless control signal for controlling the lighting apparatus 200. The communication module 290 is connected to the control module 240. The communication module 290 is spaced apart from the light source 210, and crosses the light source coupling part 220, the heat sink 280 and the shield cover 260. The communication module 290 is coupled to the control module 240. The communication module 290 includes a substrate 310, a connecting terminal 320, a ground part 330, an antenna device 340 and a protection cover 350.

The substrate 310 is provided for a support in the communication module 290. The substrate 310 has a flat structure. The substrate 310 may be a PCB. In addition, the substrate 310 may include a dielectric. The substrate 310 includes a connecting region 311, a driving region 313 and an antenna region 315.

The connecting region 311 is placed at one end of the substrate 310. The connecting region 311 faces the control module 240. The connecting region 311 faces the coupling terminal 245. The connecting region 311 may face the coupling groove 246. The connecting region 311 is inserted into the heat sink 280. The connecting region 311 is received in the receiving groove. The connecting region 311 is coupled to the control module 240. The connecting region 311 is coupled to the coupling terminal 245. The connecting region 311 may be inserted into the coupling groove 246.

The driving region 313 extends from the connecting region 311. The driving region 313 is placed at the central portion of the substrate 310. The driving region 313 crosses the light source coupling part 220, the heat sink 280 and the shield cover 260. The driving region 313 is inserted into the heat sink 280. The driving region 313 receives the coupling hole 223, the inserting hole 283, the through-hole 261 and the receiving groove of the heat sink 280 which exist on the same axis.

The driving region 313 includes a driving device (not shown). The driving device is installed in the substrate 310 and disposed in the driving region 313. The driving device extends from the driving region 313. One end of the driving device extends to the connecting region 311, and the opposite end extends to the antenna region 315.

The antenna region 315 is placed at the opposite end of the substrate 310. The antenna region 315 is opposite to the connecting region 311 about the driving region 313. The antenna region 315 is connected to the connecting region 311 through the driving region 313. The antenna region 315 is protruded from the heat sink 280. The antenna region 315 is exposed from the heat sink 280. The antenna region 315 is placed over the light source coupling part 220. The antenna region 315 may be spaced apart from the light source 210.

The connecting terminal 320 is provided for an interface between the communication module 290 and the control module 240. The connecting terminal 320 is disposed in the connecting region 311 of the substrate 310. The connecting terminal 320 is connected to one end of the driving device. The connecting terminal 320 is connected to the control module 240. The connecting terminal 320 is coupled to the coupling terminal 245 together with the connecting region 311 to connect with the coupling terminal 245. The connecting terminal 320 may be inserted into the coupling groove 246. An electric power is provided to the communication module 290 through the connecting terminal 320. That is, the electric power is provided from the coupling terminal 245 to the connecting terminal 320.

The ground part 330 is provided for a ground of the communication module 290. The ground part 330 is disposed in the connecting region 311 of the substrate 310. The ground part 330 may be spaced apart from the ground terminal 320. The ground part 330 may not make contact with the connecting terminal 320. The ground part 330 may be connected to one end of the driving device.

The antenna device 340 performs a wireless communication function in the communication module 290. The antenna device 340 resonates in a predetermined frequency band, so that the antenna device 190 transceives an electromagnetic wave. The antenna device 340 resonates at a predetermined impedance. The antenna device 340 is disposed in the antenna region 315 of the substrate 310. The antenna device 340 is connected to an opposite end of the driving device. That is, the antenna device 340 is connected to the connecting terminal 320 through the driving device. The antenna device 340 may be connected to the ground part 330 through the driving device. One end of the antenna device 340 is connected to the driving device and the opposite end is opened.

The antenna device 340 is protruded from the heat sink 280. The antenna device 340 is disposed at an outside of the heat sink 280. The antenna device 340 together with the antenna region 315 is exposed from the heat sink 280. The antenna device 340 is spaced apart from the heat sink 280. A gap distance d between the antenna device 340 and the heat sink 280 may be about 1 mm or more. The antenna device 340 is disposed In addition, the antenna device 190 may be spaced apart from the light source 110

The antenna device 240 is driven with the electric power supplied from the connecting terminal 320. The antenna device 340 receives the wireless control signal for controlling the control module 240. The antenna device 340 transmits the wireless control signal to the control module 240. The antenna device 340 transmits the wireless control signal to the control module 240 through the connecting terminal 320.

The antenna device 340 may be formed in a patch type and thus, may be attached into the antenna region 315. The antenna device 340 may be formed in the antenna region 315 by drawing the antenna device 340 with a conductive ink. Also, the antenna device 340 may be patterned in the antenna region 315. The antenna device 340 may be formed in at least one of bar, meander, spiral, step and loop types. The antenna device 340 may be made of a conductive material. The antenna device 340 may include at least one of Ag, Pd, Pt, Gu, Au and Ni.

The protection cover 350 receives the substrate 310. The protection cover 350 covers the substrate 310. The protection cover 350 covers the driving region 313 and the antenna region 315, and exposes the connecting region 311. The protection cover 350 receives the antenna device 340 and exposes the connecting terminal 320. In other words, the connecting terminal 320 is protruded from the protection cover 350. The light distribution cover 130 may be formed of at least one of plastic, polypropylene, polyethylene and polycarbonate. The protection cover 350 includes a first protection cover 351 and a second protection cover 353.

The first protection cover 351 surrounds the driving region 313. The first protection cover 351, together with the driving region 313, crosses the light source coupling part 220, the heat sink 280 and the shield cover 260. The first protection cover 351 is inserted into the heat sink 280. The first protection cover 351 is received in the coupling hole 223, the inserting hole 283, the through-hole 261 and the receiving groove of the heat sink 280 which are aligned on the same axis.

The second protection cover 353 receives the antenna region 315. In addition, the second protection cover 353 receives the antenna device 340. The second protection cover 353 extends from the first protection cover 351. An inserting groove is formed in the second protection cover 353. That is, the antenna device 340 is received in the inserting groove of the second protection cover 353 together with the antenna region 315.

The second protection cover 353 is protruded from the heat sink 280. The second protection cover 353 is exposed from the heat sink 280. The second protection cover 353 allows the antenna device 340 to be spaced apart from the heat sink 280. The second protection cover 353 is placed on the light source coupling part 220. The second protection cover 353 is coupled to the heat sink 280. The second protection cover 353 is formed in a larger size than that of the inserting hole 283, such that the second protection cover 353 is not inserted into the heat sink 280.

According to the embodiment, the lighting apparatus 200 has the wireless communication function. The lighting apparatus 200 can receive the wireless control signal through the communication module 290. The lighting apparatus 200 is capable of controlling the light source 210 according to the wireless control signal. That is, a user of the lighting apparatus 200 is capable of easily controlling the lighting apparatus 200. Thus, the user convenience of the lighting apparatus 200 can be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A lighting apparatus comprising:

a control module that supplies an electric power;

a heat sink that receives the control module;

a light source module mounted on the heat sink and including a light source connected to the control module;

a contact member provided on the light source module; and an antenna device provided on the light source module and connected to the control module, wherein the control module includes a communication unit that drives the antenna device, wherein the communication unit includes a coupling terminal that connects the communication unit to the antenna device, and wherein the contact member is configured to allow the antenna device to make contact with the coupling terminal.

2. The lighting apparatus of claim 1, wherein the coupling terminal protrudes from the heat sink.

3. The lighting apparatus of claim 1, wherein the coupling terminal includes a first coupling terminal that supplies the electric power to the antenna device; and a second coupling terminal that grounds the antenna device.

4. The lighting apparatus of claim 1, wherein the light source module further includes a light source coupling part that receives the light source and on which the light device is mounted.

5. The lighting apparatus of claim 1, further comprising:

a communication module on which the antenna device is mounted, wherein the communication module includes a connecting terminal inserted into the heat sink to connect the antenna device to the control module.

6. The lighting apparatus of claim 5, wherein the antenna device is spaced apart from the heat sink.

7. The lighting apparatus of claim 5, wherein the communication module further includes a driving device that connects the connecting terminal to the antenna device and drives the antenna device.

8. The lighting apparatus of claim 5, wherein the communication module further includes a substrate including a connection region in which the connecting terminal is provided; and an antenna region in which the antenna device is provided.

9. The lighting apparatus of claim 8, wherein the communication module further includes a protection cover that covers the substrate, receives the antenna device and exposes the connecting terminal.

10. The lighting apparatus of claim 9, wherein the protection cover includes:

a first protection cover inserted into the heat sink; and a second protection cover coupled to the heat sink to protrude from the heat sink.

11. The lighting apparatus of claim 8, wherein the substrate further includes a ground part provided in the connection region, spaced apart from the connecting terminal and that grounds the antenna device.

12. The lighting apparatus of claim 5, wherein the control module includes a coupling terminal which is coupled to and makes contact with the connecting terminal in the heat sink.

* * * * *